US007011031B1

(12) United States Patent
Bradley

(10) Patent No.: US 7,011,031 B1
(45) Date of Patent: Mar. 14, 2006

(54) ADJUSTABLE QUILTING MACHINE

(76) Inventor: James Bradley, 17075 Kirkland Dr., Cottonwood, CA (US) 96022

( * ) Notice: Subject to any disclaimer, the term of this patent is extended or adjusted under 35 U.S.C. 154(b) by 142 days.

(21) Appl. No.: 10/941,743

(22) Filed: Sep. 15, 2004

(51) Int. Cl.
*D05B 11/00* (2006.01)

(52) U.S. Cl. ..... 112/119; 112/475.08

(58) Field of Classification Search ..... 112/117, 112/118, 119, 102, 103, 475.08, 304, 314, 112/318, 322; 38/102.1, 102.21, 102.91; 108/1, 10, 23, 115, 116, 127, 139, 144.11; 362/33, 90, 372
See application file for complete search history.

(56) References Cited

U.S. PATENT DOCUMENTS 454,520 A * 6/1891 Gibbs ..... 112/119
575,764 A * 1/1897 Wilson ..... 112/119
4,192,241 A * 3/1980 Reed et al. ..... 112/117
5,711,236 A * 1/1998 Badger ..... 112/117
6,151,816 A * 11/2000 Bagley ..... 38/102.21
6,615,756 B1 9/2003 Barrus ..... 112/119
6,631,688 B1 10/2003 Maag ..... 112/118
6,792,884 B1 * 9/2004 Barrus ..... 112/475.08

* cited by examiner

*Primary Examiner*—Ismael Izaguirre

(57) ABSTRACT

An improved quilting machine includes a table having a carriage for supporting a sewing machine on the table and translating the sewing machine in two axes, a quilting rack for supporting one or more layers of fabric in a substantially planer orientation relative to the sewing machine, and foldable legs. The quilting rack is suspended above the table on a rotatable vertical support, and is easily adjustable without tools for positioning the fabric in a convenient orientation for machine quilting, hand sewing, or access to the table. A lamp is attached through a flexible assembly to the carriage for directing illumination to the sewing machine. The lamp moves with the carriage so that illumination tracks the sewing machine. The quilting rack and legs are foldable and, combined with the rotatable vertical support, provide for convenient transportation and storage of the quilting machine.

24 Claims, 8 Drawing Sheets

ADJUSTABLE QUILTING MACHINE

BACKGROUND OF THE INVENTION

1. Field of the Invention

The present invention relates to quilting machines that support a sewing machine over a workpiece on a table.

2. Description of the Related Art

Throughout American history, quilting has been a popular pastime. The craft today has experienced a resurgence in popularity and enjoys immense participation by hobbyists in quilting shows, magazines, newsletters, clubs, societies, and the like. Although traditional quilt making may be at the root of this resurgence, the development of modern textiles, machinery, and laborsaving sewing devices may be contributing to this resurgence, as many activities compete for the time of the average hobbyist or craftsperson.

Quilting typically involves stitching together multiple layers of fabric to form, in a manner of speaking, a new fabric. In some instances, quilting may include sewing together a myriad of smaller pieces of fabric to form a single composition fabric or material. A quilt typically includes an upper and lower layer of fabric having a layer of batting introduced therebetween for thickness, padding and/or warmth. As appreciated, quilts may be created in various shapes and sizes, such as for example, from small and ornamental, to those that cover large beds, or those that are mounted to decorate walls.

Designs or patterns are usually sewn or stitched into a quilt by hand or with a sewing machine, thereby adding an artistic element to the craft of quilt making. Some designs or patterns may be very elaborate, thus requiring a high degree of skill and dexterity on the part of the craftsperson or hobbyist. In some cases, sewing machines may be equipped with preprogrammed stitching patterns to assist in performing these tasks more accurately and with a greater degree of intricateness than quilting by hand. More importantly, extravagant quilting generally incorporates elaborate designs that may require many hours of work even by the most skilled craftsperson.

Due to the extensive time commitment realized by a typical quilter using hand-sewing methods to produce a quilt for a bed or for a decorative wall hanging, those skilled in the art developed industrial quilting assemblies for use in producing quilts in high quantities. These types of industrial quilting assemblies typically include heavy duty, bulky sewing machines disposed in a stationary position wherein the subject quilt, mounted on a quilting rack, is moved relative to the head of the sewing machine. Unfortunately, these types of prior art industrial quilting assemblies require an elaborate work area to move and position the quilting rack supporting the layers of quilting material relative to the stationary head of the sewing machine. In particular, a very wide and long work space is generally required since the movement of the quilting rack relative to the head of the sewing machine may encompass twice the width and length of the support frame itself.

Household sewing machines have resulted in both tremendous time-savings and quality improvements over traditional hand-sewing methods. Nevertheless, manipulating large quilts with respect to stationary sewing machines is typically a cumbersome and laborious process. "Long arm" quilting machines were developed by those skilled in the art, in part, to address the problems associated with manipulating large quilts when stitching the multiple layers of the quilt together. In particular, instead of moving a quilting rack supporting a quilt with respect to a sewing machine, the quilting rack may be maintained stationary, and the sewing machine may then be moved with respect to the width of the quilt. In order to accomplish this task successfully, a quilting rack is generally needed to maintain the quilt in a substantially planar configuration; a vertical support is generally needed to position the quilting rack relative to a the sewing machine; and a carriage system may be needed to move the sewing machine with respect to the length and width of the quilt.

Unfortunately, "long arm" sewing machines of the prior art are usually complex in configuration, bulky, heavy, inflexible, and usually unaffordable to the typical consuming hobbyist or quilting craftsperson. As appreciated by those skilled in the art, commercial "long arm" sewing machines may cost upwards of several thousand dollars, making them generally out of reach and impractical to many quilting hobbyists. Moreover, specially designed "long arm" sewing machines and fixed frame assemblies are typically required to provide means for quilting using prior art quilting assemblies, thereby making a hobbyist's household sewing machine practically unusable in the task. In addition, many of the prior art quilting assemblies cannot perform desired stitching or sewing since the maneuverability of the head of the sewing machine is affected by its own mechanical and structural restrictions.

Conventional household sewing machines typically include many of the stitching functions necessary for quilting and are very affordable. Unfortunately, such machines are generally intended to remain stationary when being used for sewing and may simply lack the wherewithal to be accurately movable with respect to the dimensional length and width of a quilt so as to accomplish the appropriate stitching and/or creative stitching designs desired by the user. In addition to the foregoing, workspace is typically an issue to the average hobbyist or quilting craftsperson.

Quilting assemblies have been developed to resolve such issues of stationary sewing machines and large, fixed size quilting racks. For example, U.S. Pat. No. 6,615,756 discloses such a typical quilting assembly including a carriage for movably supporting a sewing machine. The carriage rides on tracks arranged to translate the carriage in an X and a Y-axis while the quilt remains stationary. A quilting rack supports the quilt and includes dispensing rollers and a take-up roller separated by about the depth of a typical sewing machine arm. The quilting rack allows sections of a quilt to be positioned in the arm of the sewing machine. The quilting rack is supported on rigid "L" shaped brackets that are clamped to a table at a fixed position. The clamping position for the "L" shaped brackets depends on desired the length of the quilt. The "L" shaped brackets permit vertical adjustment of the quilting rack position. Unfortunately, the "L" shaped brackets do not allow for convenient horizontal adjustment of the quilting rack position. This makes it difficult to position the quilt for hand sewing or for clear access to the table work surface, without unclamping and removing the "L" shaped brackets. Moreover, transportation and storage requires unclamping and disassembly of the "L" shaped brackets, and complex reassembly for further use. Such adjustment, disassembly, and reassembly takes substantial time and generally involves tools typically not immediately available to the average home quilter or hobbyist. Moreover, there is no provision for lighting, directed to the work area, that tracks the sewing machine position.

U.S. Pat. No. 6,631,688 discloses a quilting rack for sewing machines including a quilting rack mounted on a vertical support that is attached to a metal frame. The metal frame supports a carriage assembly capable of side to side and of forward and rearward translation of the sewing machine. A laser pointer is attached to the sewing machine and directed to a template to give position feedback. The vertical support permits vertical adjustment of the quilting rack. Unfortunately, the vertical support is rigidly attached to the metal frame and does not permit horizontal adjustment of the quilting rack position even with disassembly. Moreover, the quilting rack cannot be tilted on the vertical support. This makes it virtually impossible to reposition the quilt for hand sewing. It is necessary to disassemble the apparatus and remove it entirely for clear access to the table work surface. Transportation and storage require disassembly of the metal frame and vertical support. Such disassembly involves tools typically not immediately available to the average home quilter or hobbyist.

The working components of prior art quilting assemblies have also been found to be heavy, bulky in size, difficult to adjust, and generally require tools for the average quilting hobbyist or craftsperson to assemble, disassemble, handle, and move. Therefore, what is needed is a quilting apparatus that permits the quilting rack to be quickly and easily adjusted horizontally, vertically and tilted to place the quilting rack in a convenient position for quilting, hand sewing, and clear access to the table working surface, without disassembly, that can be easily collapsed for storage and transportation and can be setup for use in a matter of a few minutes, without requiring tools, and which provides improved lighting directed to the work area, that tracks the sewing machine. The present invention meets these needs.

SUMMARY OF THE INVENTION

An embodiment of the present invention is a quilting apparatus for guiding a sewing machine relative to at least one layer of fabric. The quilting apparatus includes a table having a working surface and a quilting rack configured to selectively take in and pay out the fabric in a substantially planar orientation defined by lateral and longitudinal dimensions, the quilting rack being mountable with respect to the working surface. The quilting apparatus further includes a carriage assembly supported by the working surface and configured to selectively transport the sewing machine with respect to the fabric along the lateral and longitudinal dimensions of the quilting rack. The quilting apparatus further includes at least one vertical support that is rotatably connected to the table relative to an end of the at least one vertical support, the quilting rack being rotatably mounted to the at least one vertical support, wherein a horizontal tilted position of the quilting rack is selectively adjustable in the lateral dimension of the working surface by selectively rotating the at least one vertical support at the table connection, said quilting rack having a vertical mode distal the sewing machine to expose the working surface. Moreover, a vertical height of the quilting rack is selectively adjustable with respect to the working surface by a movable mount to the at least one vertical support to allow a transport mode flat against the table. Moreover, a tilt of the quilting rack is selectively adjustable with respect to the working surface by selectively rotating the quilting rack on the at least one vertical support.

An embodiment of the present invention is a quilting apparatus for guiding a sewing machine relative to at least one layer of fabric. The quilting apparatus includes a table having a working surface and a quilting rack configured to selectively take in and pay out the fabric in a substantially planar orientation defined by lateral and longitudinal dimensions, the quilting rack being mountable with respect to the working surface. The quilting apparatus further includes a carriage assembly supported by the working surface and configured to selectively transport the sewing machine with respect to the fabric along the lateral and longitudinal dimensions of the quilting rack. The quilting apparatus further includes a first manually operated fastener and a second manually operated fastener and a vertical support wherein the vertical support is rotatably connected to the table relative to an end of the vertical support by the first manually operated fastener, and the quilting rack is rotatably mounted to the vertical support by the second manually operated fastener. Moreover, a horizontal position of the quilting rack is selectively adjustable in the lateral dimension of the working surface by selectively rotating the at least one vertical support. Moreover, a vertical position of the quilting rack is selectively adjustable with respect to the working surface by selectively mounting the quilting rack to the at least one vertical support. Moreover, a tilt of the quilting rack is selectively adjustable with respect to the working surface by selectively rotating the quilting rack on the at least one vertical support.

An embodiment of the present invention is a quilting apparatus for supporting at least one layer of fabric in multiple positions relative to a movable sewing machine. The quilting apparatus includes a table configured to support the movable sewing machine; one or more legs configured to support the table; and a quilting rack configured to selectively pay out and take in the one or more layers of fabric in a substantially planner configuration. The apparatus further includes a first vertical support, and a second vertical support. The first vertical support is rotatably connected to the table by a manually operated fastener relative to an end of the first vertical support and the second vertical support is rotatably connected to the table by another manually operated fastener relative to an end of the second vertical support. The first vertical support is further rotatably connected by another manually operated fastener to the quilting rack and the second vertical support is further rotatably connected by another manually operated fastener to the quilting rack. The manually operated fastener connecting the first vertical support to the table and the manually operated fastener connecting the second vertical support to the table enable a user to rotate the first vertical support and the second vertical support to position the quilting rack horizontally. Moreover, the manually operated fastener connecting the first vertical support to the quilting rack and the manually operated fastener connecting the second vertical support to the quilting rack enable the user to tilt the quilting rack and to position the quilting rack vertically relative to the table. Moreover, the user may conveniently position the quilting rack for quilting with the movable sewing machine, for manual quilting, in a position for full access to the table with the quilting rack vertical, and in a transport mode with the one or more legs against the table.

An embodiment of the present invention is a quilting apparatus for supporting and moving a sewing machine relative to at least one layer of fabric. The quilting apparatus includes a table, a movable carriage configured to move in two axes relative to a surface of the table, the movable carriage adapted to support the sewing machine, and a quilting rack configured to selectively pay out and take in the one or more layers of fabric in a substantially planner orientation relative to the sewing machine on the movable carriage. The quilting apparatus further includes at least one vertical support rotatably connected at an end to the table and rotatably connected to the quilting rack, and one or more legs configured to support the table, the one or more legs foldable into about the plane of the table for storage and transportation.

An embodiment of the present invention is a method for guiding a sewing machine relative to at least one layer of fabric mounted on a quilting rack. The method includes the steps of paying out the fabric in a substantially planar orientation with the quilting rack defined by lateral and longitudinal dimensions, and mounting the quilting rack with respect to a working surface. The method further includes guiding the sewing machine with respect to the fabric along both the lateral and longitudinal dimensions of the quilting rack by means of a carriage assembly supported by the working surface, and connecting at least one vertical support rotatably to the table relative to an end of the at least one vertical support. The method further includes mounting the quilting rack rotatably to the at least one vertical support and adjusting a horizontal position of the quilting rack selectively in the lateral dimension of the working surface by rotating the at least one vertical support selectively. The method further includes adjusting a vertical position of the quilting rack selectively with respect to the working surface by mounting the quilting rack selectively to the at least one vertical support, and adjusting a tilt of the quilting rack selectively with respect to the working surface by selectively rotating the quilting rack on the at least one vertical support.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the present invention may admit to other equally effective embodiments.

DETAILED DESCRIPTION OF THE PREFERRED EMBODIMENT

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

Figure 1:
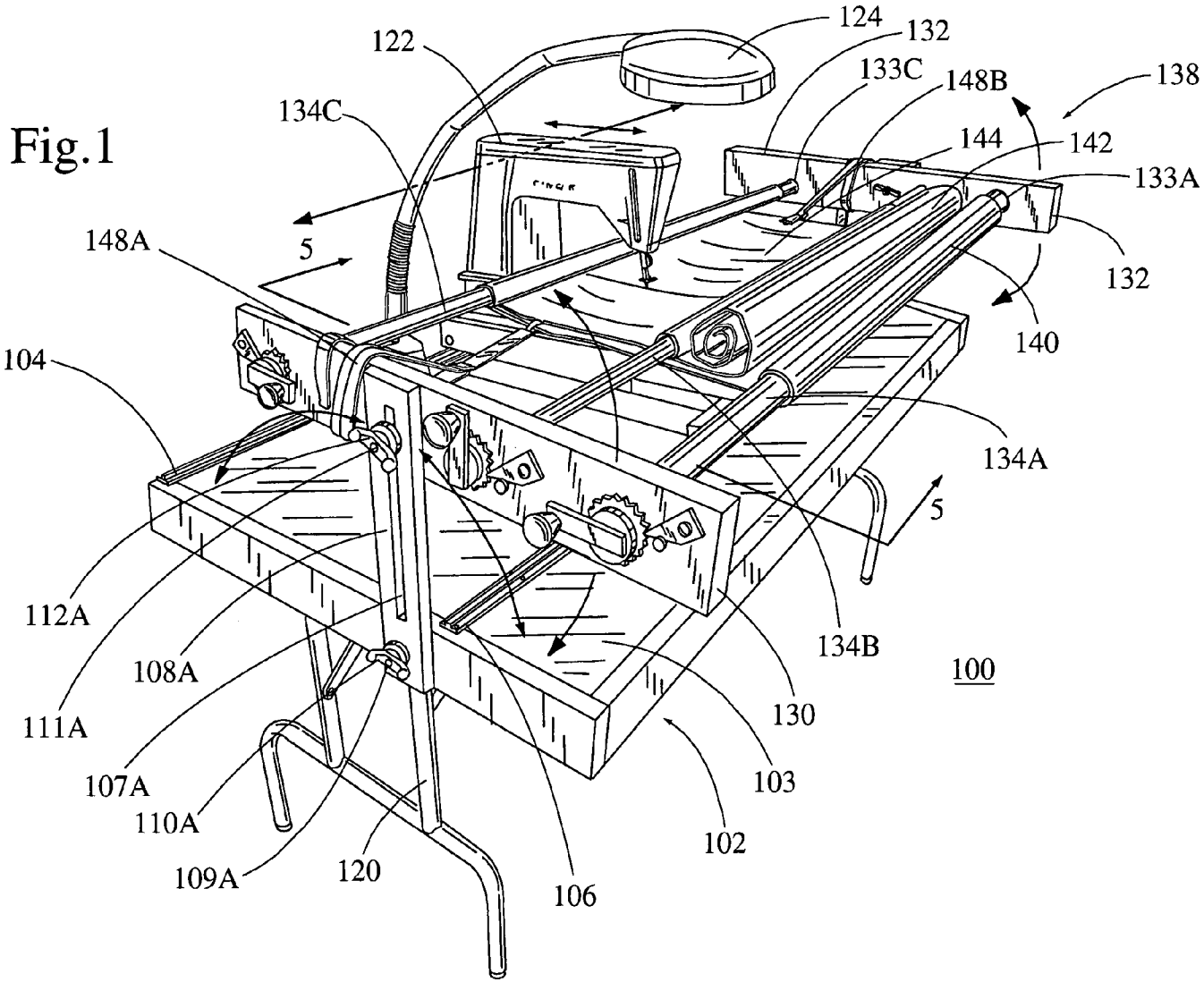
FIG. 1 is a rear perspective view of one embodiment of a quilting apparatus in accordance with aspects of the invention.
Figure 2:
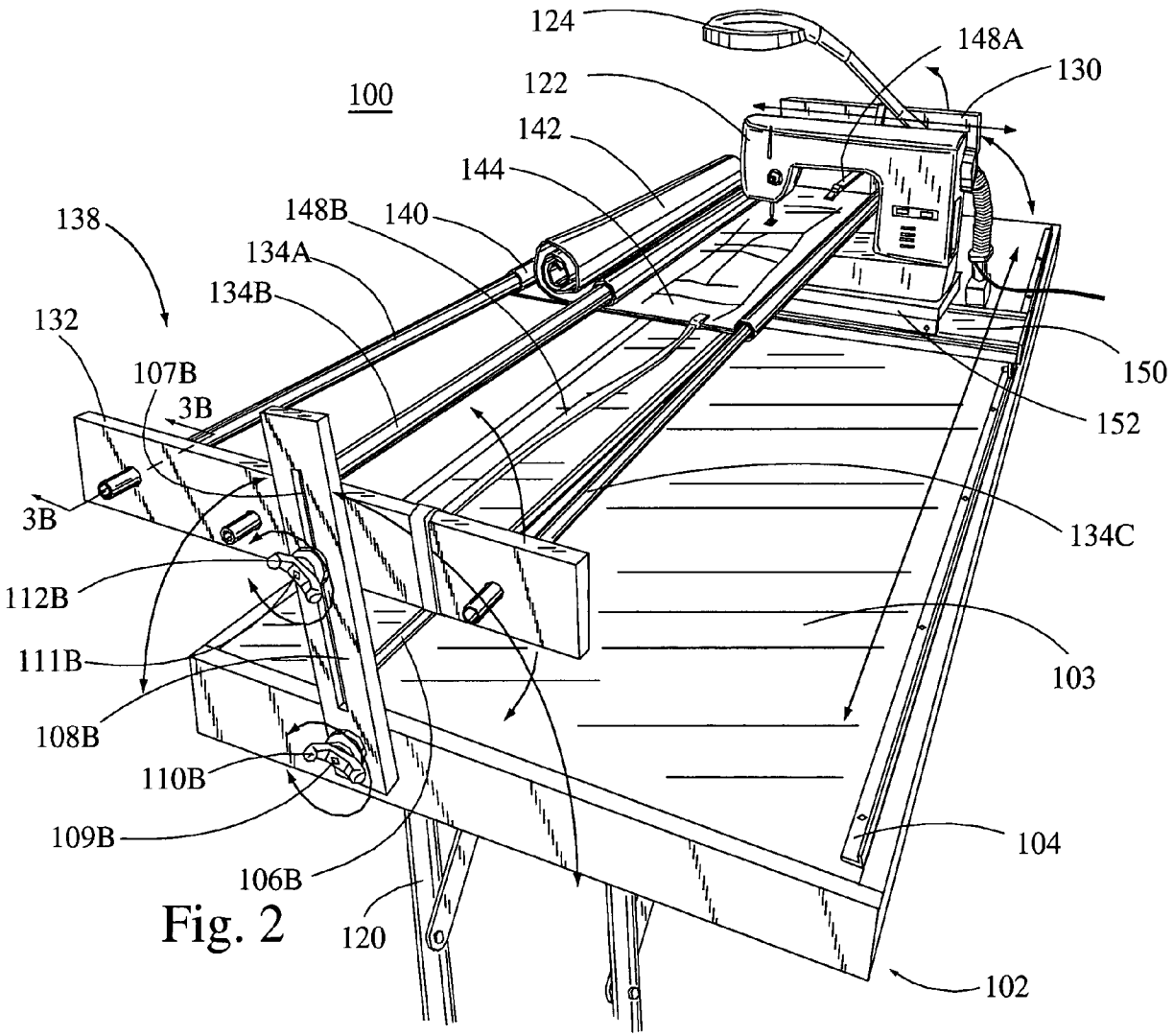
FIG. 2 is an front perspective view of the FIG. 1 embodiment.

Referring first to FIGS. 1 and 2, quilting apparatus 100 includes a table 102, a quilting rack 138, a vertical support 108A, a vertical support 108B, and two or more legs 120. Table 102 is supported on legs 120. Vertical support 108A and vertical support 108B are rotatably secured to table 102 by a wing nut 110A and a wing nut 110B respectively. Wing nut 110A and wing nut 110B are secured to a bolt 109A and a bolt 109B respectively. Vertical support 108A,B may be secured by a type of a fastener that allows vertical support 108A,B to rotate about such fastener, such as wing nut 110A,B and bolt 109A,B, a rivet, a screw, a cam-lock bolt, a quick disconnect bolt such as a type used to secure a bicycle wheel, or a lag bolt attached to table 102, for example.

Figures 3A, 4A, 5:
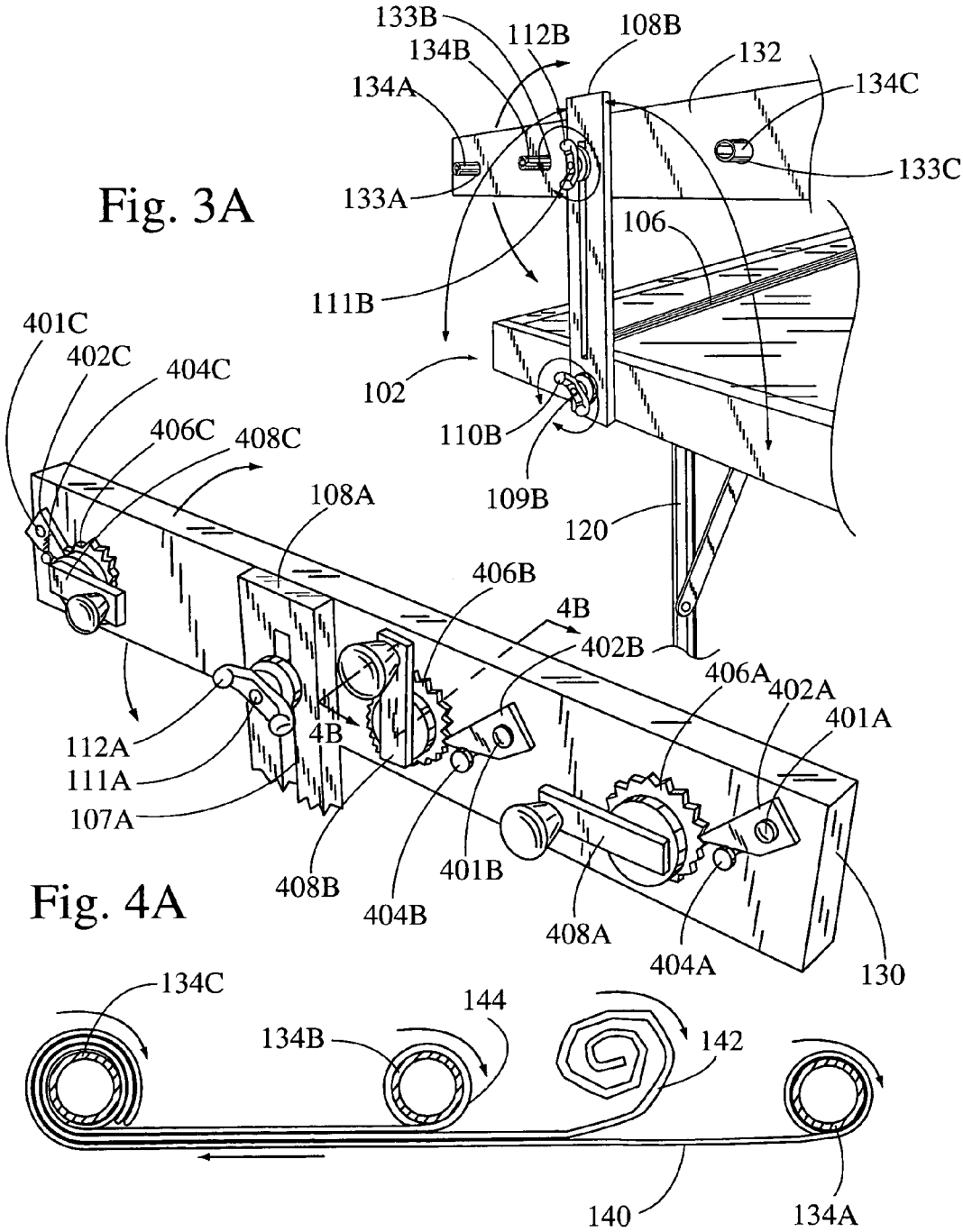
FIG. 3A is a partial perspective view of a rack frame of the quilting apparatus of FIG. 2.
FIG. 4A is an enlarged perspective view of a rack frame of the quilting apparatus of FIG. 1, in accordance with aspects of the invention.
FIG. 5 is a cross sectional view of one embodiment of a quilting rack of the quilting apparatus of FIG. 1 taken along line 5—5.
Figure 3B:
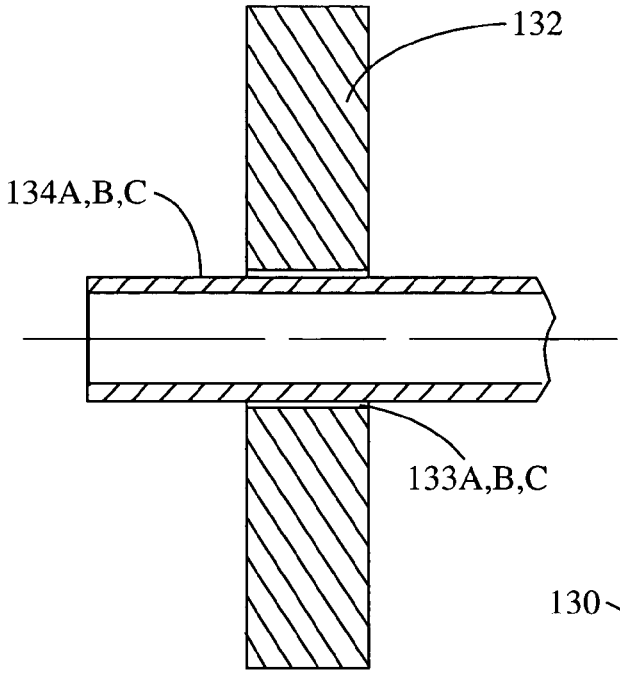
FIG. 3B is a cross sectional view of a rack frame of the quilting apparatus of FIG. 2 taken along line 3B—3B.

Referring to FIGS. 3A and 3B, quilting rack 138 includes a rack frame 130, a roller 134A, a roller 134B, a roller 134C and rack frame 132. Rack frame 132 includes a receiving aperture 133A, 133B, and 133C disposed along its length. Receiving aperture 133A is disposed proximate an end of rack frame 132. Receiving aperture 133C is disposed proximate another end of rack frame 132. Receiving aperture 133B is disposed between receiving aperture 133A and receiving aperture 133C. Receiving apertures 133A,B,C are adapted to receive rollers 134A,B,C respectively.

Vertical support 108A includes a slot 107A disposed longitudinally along a portion of the length of vertical support 108A. Vertical support 108B includes a slot 107B disposed longitudinally along a portion of the length of vertical support 108B. Quilting rack 138 may be rotatably secured to vertical support 108A,B. Rack frame 130 may be rotatably secured to vertical support 108A by bolt 111A passed through slot 107A and wing nut 112A attached to such bolt 111A. Rack frame 130 may be secured by a type of a fastener that allows rack frame 130 to rotate about such fastener, such as wing nut 112A and bolt 111A, a rivet, a screw, a cam-lock bolt, a quick disconnect bolt, or a lag bolt attached to rack frame 130, for example. Rack frame 132 may be rotatably secured to vertical support 108B by bolt 111B passed through slot 107B and wing nut 112B attached to such bolt 111B. Rack frame 132 may be secured by a type of a fastener that allows rack frame 132 to rotate about such fastener, such as wing nut 112B and bolt 111B, a rivet, a screw, a cam-lock bolt, a quick disconnect bolt, or a lag bolt attached to rack frame 132, for example.

Rotation of 108B,C permits positioning of quilting rack 138 at a desired horizontal position relative to table 102. Vertical positioning of quilting rack 138 along slots 107A,B permits placement of quilting rack 138 at a desired height above table 102. Rotation of quilting rack 138 permits quilting rack 138 to be tilted to at a desired angle, for example parallel, with respect to table 102.

Figure 4B:
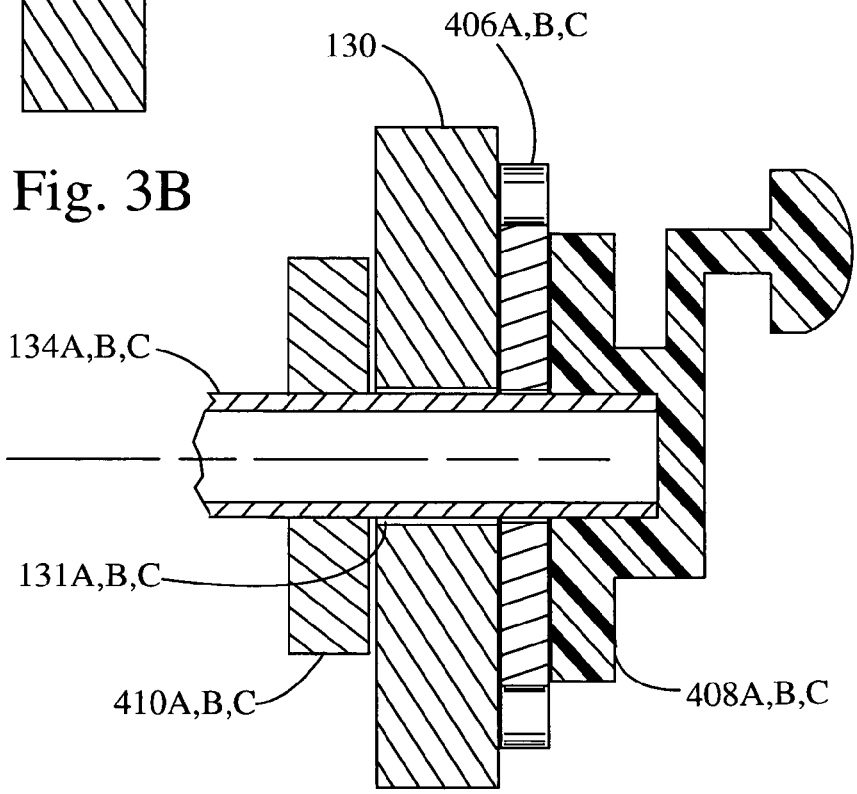
FIG. 4B is a cross sectional view of the rack frame of FIG. 4A taken along line 4B—4B.

Referring to FIGS. 4A and 4B, rack frame 130 includes a receiving aperture 131A, 131B, and 131C disposed along its length. Receiving aperture 131A is disposed proximate an end of rack frame 130. Receiving aperture 131C is disposed proximate another end of rack frame 130. Receiving aperture 131B is disposed between receiving aperture 131A and receiving aperture 131C. Receiving apertures 131A,B,C are adapted to receive rollers 134A,B,C respectively.

Rack frame 130 further includes a ratchet 406A, a pawl 402A, a crank handle 408A, a roller retainer 410A, a stop 404A and a pivot 401A. Rack frame 130 further includes a ratchet 406B, a pawl 402B, a crank handle 408B, a roller retainer 410C, a stop 404B and a pivot 401B. Rack frame 130 further includes a ratchet 406C a pawl 402C, a crank handle 408C, a roller retainer 410C, a stop 404C and a pivot 401C. Ratchet 406A,B,C may be rotated by crank handle 408A,B,C. Pawl 402A,B,C pivots about pivot 401A,B,C and bears on stop 404A,B,C. It will be appreciated by those skilled in the art that pawls 402A,B cooperate with pivots 401A,B respectively and stops 404A,B respectively to engage ratchets 406A,B respectively and to constrain such ratchets 406A,B to a counterclockwise rotation. Clockwise rotation of ratchet 406A,B may be accomplished by disengaging pawl 402A,B. It will be appreciated by those skilled in the art that pawl 402C cooperates with pivot 401C and stop 404C to engage ratchet 406C and to constrain such ratchet 406C to a clockwise rotation. Counterclockwise rotation of ratchet 406C may be accomplished by disengaging pawl 401C. Ratchet 406A is connected to roller 134A and provides control for rotation of roller 134A. Ratchet 406B is connected to roller 134B and provides control for rotation of roller 134B. Ratchet 406C is connected to roller 134C and provides control for rotation of roller 134C.

Roller 134A, roller 134B and roller 134C are suspended between rack frame 130 and rack frame 132. Rollers 134A, B,C engage rack frame 130 and are suspended in receiving apertures 131A,B,C respectively, proximate an end of rollers 134A,B,C. Rollers 134A,B,C span an intervening space between rack frame 130 and rack frame 132. Rollers 134A, B,C also engage rack frame 132 and are suspended in receiving apertures 133A,B,C respectively proximate another end of rollers 134A,B,C. Roller retainers 410A, 410B and 410C engage rollers 134A, 134B, and 134C respectively, proximate rack 130 distal handles 408A, 408B, and 408C respectively. Roller retainers 410A,B,C retain rollers 134A,B,C relative to rack 130.

Referring to FIG. 5, a lower fabric 140, an upper fabric 144 and a batting 142 may be disposed on quilting rack 138. Lower fabric 140 may be wrapped or spooled on roller 134A. Upper fabric 144 may be wrapped or spooled on roller 134B. Batting 142 may be disposed between lower fabric 140 and upper fabric 144 in a loose role resting on lower fabric 140. Rollers 123A,B,C function as support members to dispose fabric in an approximately planer orientation and about taught. Lower fabric 140, batting 142 and upper fabric 144 may be taken up on roller 134C by rotating roller 134C. Roller 134A and roller 134B may be coordinated to rotatably pay out lower fabric 140 and upper fabric 144 respectively with batting 142 disposed between lower fabric 140 and upper fabric 144. Roller 134C may be configured to rotatably take up lower fabric 140 and upper fabric 144 along with batting 142, about simultaneously. Paying out and taking up fabric with rollers may also be referred to as spooling. Roller 134C may further be adapted, by means of ratchet 406C and pawl 401C for example, to maintain lower fabric 140, upper fabric 144, and batting 142 approximately taught and in about a planer configuration as such roller 134C rotates to take up lower fabric 140 and upper fabric 144. Referring back to FIG. 1 and FIG. 2, quilting rack 138 further includes a tensioner 148A and a tensioner 148B. Tensioner 148A and tensioner 148B may be constructed of elastic materials and may cooperate with rollers 134A,B,C to maintain lower fabric 140 and upper fabric 144, along with batting 142 approximately taught and about planer.

Figure 6:
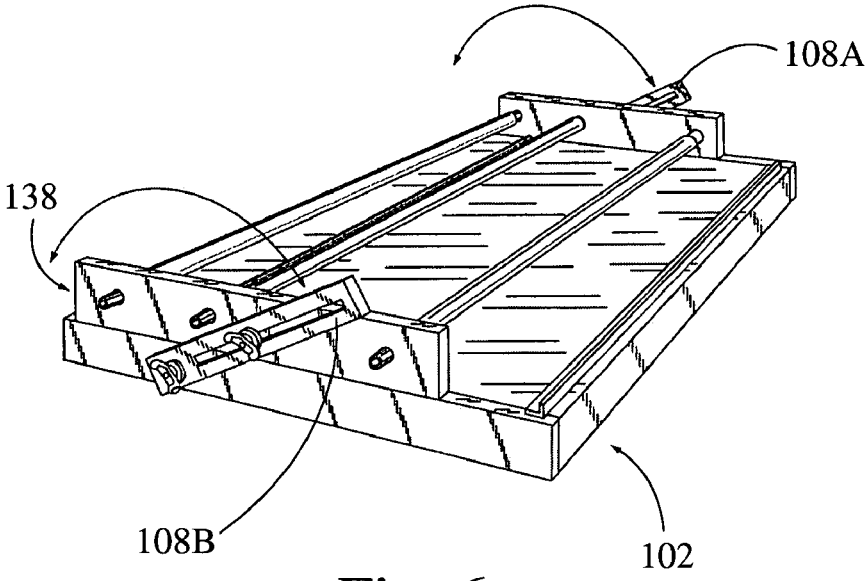
FIG. 6 is a top perspective view of the quilting apparatus of FIG. 1 showing a quilting rack configured for storage and transport.

Referring to FIG. 6, wing nut 110B, wing nut 112B, wing nut 110A (not visible from this perspective) and wing nut 112A (not visible from this perspective) may be loosened. Support arm 108A,B may be rotated to position quilting rack 138 relative to table 102 for advantage and quilting rack 138 may be tilted and positioned vertically along support arms 108A,B to place quilting rack 138 proximate table 102. Legs 120 have been folded (as described below) to about a plane of table 102 for storage and transport. No tools are necessary to configure quilting apparatus 100 as illustrated in FIG. 6.

Figure 7:
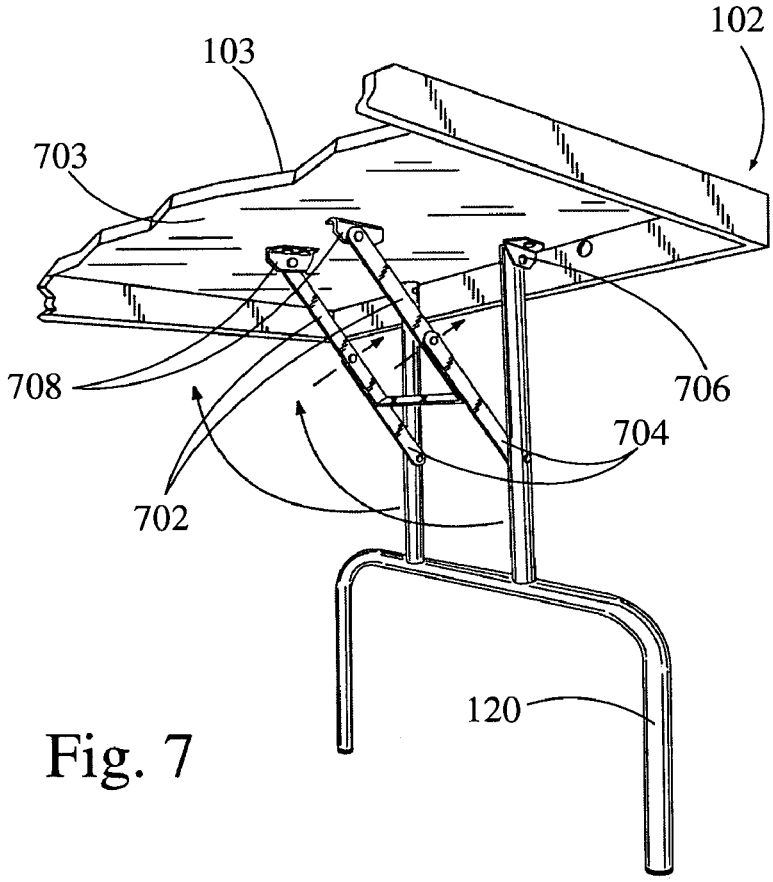
FIG. 7 is a bottom perspective view of one embodiment of table legs for a table for a quilting apparatus.

Referring to FIG. 7, quilting apparatus 100 further includes one or more table leg brackets 706, one or more lower table leg supports 704, one or more upper table leg supports 702 and one or more support brackets 708. Table leg brackets 706 may be mounted on lower surface of table 102. An upper portion of table legs 120 may be pivotally connected to table leg brackets 706 such that table legs 120 may be rotated to about a plane of table 102. Support brackets 708 may be mounted to a lower surface 703 of table 102. Upper table leg supports 702 may be pivotally connected at one end to support brackets 708. Upper table leg supports 708 may be pivotally connected at another end to lower table leg supports 704. Lower table leg supports 704 may be pivotally connected to table legs 120. Upper table leg supports 702 and lower leg supports 704 may be configured to lock table legs 120 at about a right angle with respect to table 102, and to fold allowing legs 120 to pivot to about the plane of table 102.

Figure 8:
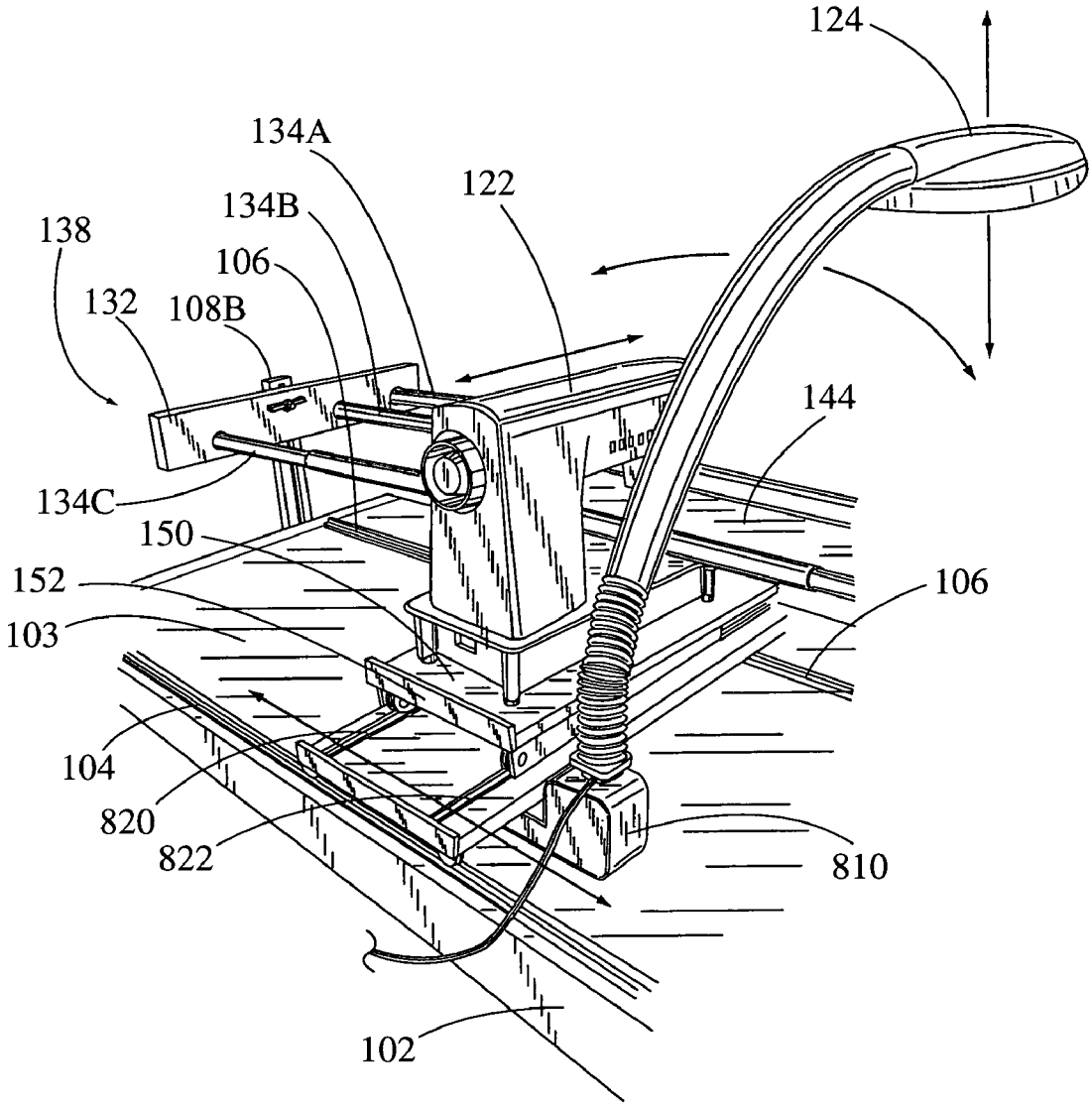
FIG. 8 is a perspective view of one embodiment of a lamp attached to a carriage in accordance with aspects of the invention.

Referring to FIG. 8, quilting apparatus 100 further includes a sewing machine 122, a carriage 150, a table surface 103, a rail 104, and a rail 106. Rail 104 and rail 106 are disposed on table surface 103 along a longitudinal axis of table 102. Carriage 150 is adapted to travel longitudinally on rail 104 and rail 106 along a substantial length of table 102. Carriage 150 includes a rail 820 and a rail 822 and a lamp base 810. Carriage 152 is adapted to travel transversally on rail 820 and rail 822 on carriage 150. Sewing machine 122 is disposed above table 102 on carriage 152 and has freedom of travel in both longitudinal axis and transverse axis. Lamp 124 may be disposed in lamp base 810 attached to carriage 150 and travels with carriage 150 in longitudinal axis. Alternatively, lamp base 810 may be attached to carriage 152 and lamp 124 may be disposed on carriage 152 and may be free to travel in both longitudinal and transverse axis. Lamp 124 may be adapted to flex in multiple axes for directing an illumination relative to sewing machine 122 to advantage. Referring back to FIG. 6 carriage 150, carriage 152 and sewing machine 122 are illustrated removed from table 102. For removal, sewing machine 122 may be simply lifted off of carriage 152. Carriage 152 may then be simply lifted off of carriage 150. Carriage 150 may be simply lifted off of table 102. No tools are required.

Figure 9:
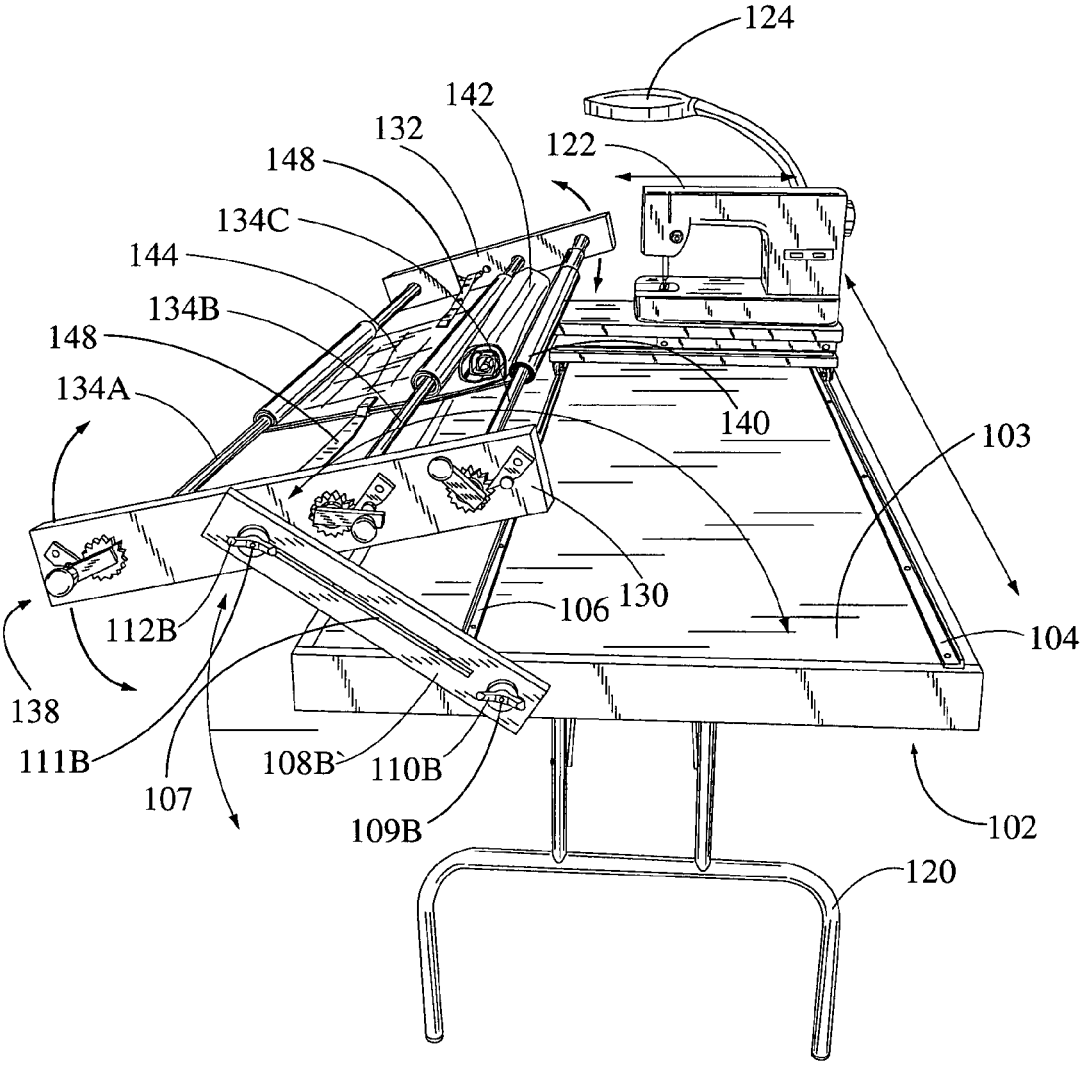
FIG. 9 is a perspective view of one embodiment of the quilting apparatus showing a quilting rack configured for manual quilting.

Referring to FIG. 9, rack supports 108A,B are illustrated rotated to a position that improves access to quilting rack 138 for manual quilting by a person sitting or standing at table 102. Quilting rack 138 may be rotated about bolt 111A,B to advantage for ease of use. It is not necessary to rotate quilting rack 138 one hundred and eighty degrees, however one-hundred and eighty degree rotation may be performed, for example, for orienting a quilting pattern for convenience of use. Wing nuts 110A and 110B may be loosened by hand, without tools, for rotation of vertical support 108A and 108B respectively to a desired position. Wing nuts 112A and 112B may be loosened by hand, without tools, for tilting of quilting rack 138 to a position convenient for manual quilting. Bolts 111A and 111B may easily be manually removed from slots 107A and 107B respectively for one hundred and eighty degree rotation of quilting rack 138 and easily reinstalled.

Figure 10:
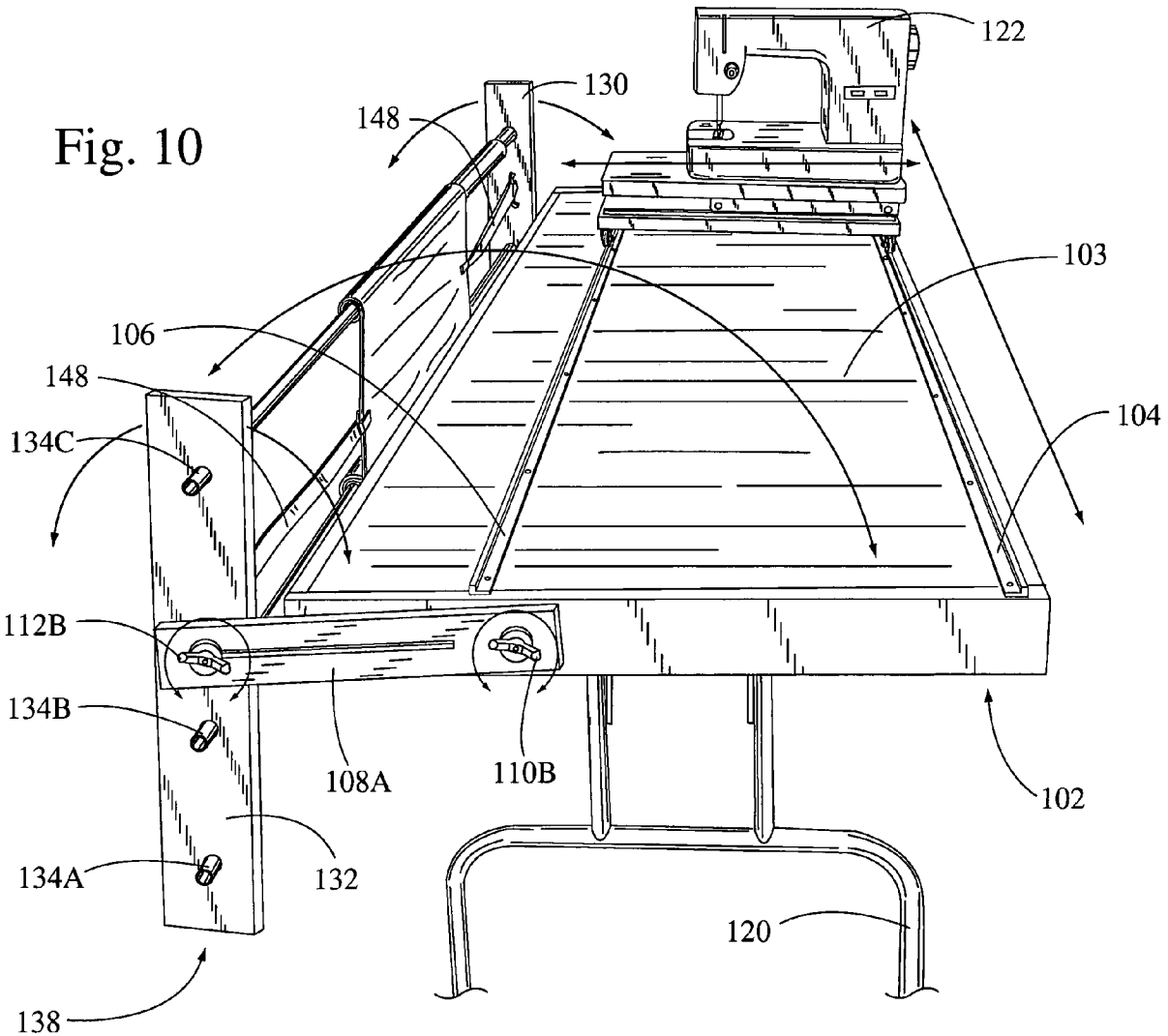
FIG. 10 is a top perspective view of one embodiment of a quilting apparatus showing a quilting rack configured for access to a table surface.

Referring to FIG. 10, table surface 103 may be used as a work platform for other activities than quilting, such as preparation of patterns or designs, for example. Vertical support 108A,B may be rotated, as illustrated in FIG. 10, to place quilting rack 138 clear of such table surface 103. Wing nuts 110A and 110B may be loosened by hand, without tools, for rotation of vertical support 108A and 108B respectively to a desired position. Wing nuts 112A and 112B may be loosened by hand, without tools, for tilting of quilting rack 138 to a position convenient for access to table surface 103.

In summary, attaching vertical support 108A,B rotatably to table 102 permits quilting rack 138 to be positioned horizontally to a desired position, for example, with respect to sewing machine 122. Attaching quilting rack 138 rotatably at slots 107A,B permits quilting rack to be positioned vertically and tilted to a desired position, for example, with respect to sewing machine 122. Moreover, such rotatable attachment of vertical support 108A,B and quilting rack 138 permits quilting rack 138 to be quickly and easily positioned clear of table surface 103, as illustrated in FIG. 10, without removing or disassembling quilting rack 138. Moreover, such rotatable attachment of vertical support 108A,B and quilting rack 138 permits quilting rack 138 to be quickly and easily rotated and tilted into a convenient position for manual quilting, as illustrated in FIG. 9. Quilting rack 138 may easily be removed and rotated one hundred and eighty degrees with respect to table 102 if desired. Moreover, such rotatable attachment of vertical support 108A,B and quilting rack 138, combined with a folding capability of legs 120 permits quilting apparatus 100 to be quickly and easily configured for transport and storage, as illustrated in FIG. 6 without need to remove or disassemble quilting rack 138 or legs 120. Mounting lamp 124 on carriage 150 permits lamp 124 to move in one axis with sewing machine 122 and maintain illumination relative to sewing machine 122. Mounting lamp 124 on carriage 152 permits lamp to move in two axes with sewing machine 122 and maintain illumination relative to sewing machine 122. Incorporating a flexible arm in lamp 124 permits easy adjustment of of lamp 124 to direct illumination to advantage.

While the foregoing is directed to embodiments of the present invention, other and further embodiments of the invention may be devised without departing from the basic scope thereof, and the scope thereof is determined by the claims that follow.

What is claimed is:

1. A quilting apparatus for guiding a sewing machine relative to at least one layer of fabric, the quilting apparatus comprising:

a table having a working surface;

a quilting rack configured to selectively take in and pay out the fabric in a substantially planar orientation defined by lateral and longitudinal dimensions, the quilting rack being mountable with respect to the working surface;

a carriage assembly supported by the working surface and configured to selectively transport the sewing machine with respect to the fabric along the lateral and longitudinal dimensions of the quilting rack;

at least one vertical support being rotatably connected to the table relative to an end of the at least one vertical support, the quilting rack being rotatably mounted to the at least one vertical support;

wherein a horizontal tilted position of the quilting rack is selectively adjustable in the lateral dimension of the working surface by selectively rotating the at least one vertical support at the table connection, said quilting rack having a vertical mode distal the sewing machine to expose the working surface;

wherein a vertical height of the quilting rack is selectively adjustable with respect to the working surface by a movable mount to the at least one vertical support to allow a transport mode flat against the table; and wherein a tilt of the quilting rack is selectively adjustable with respect to the working surface by selectively rotating the quilting rack on the at least one vertical support.

2. The quilting apparatus as defined in claim 1, wherein the carriage assembly comprises:

a first carriage component configured to transport the sewing machine along the longitudinal dimension of the quilting rack;

a track configured to mount on the working surface and restrict movement of the first carriage component to the direction defined by the longitudinal dimension of the quilting rack;

the first carriage component having wheels configured to move along the track;

a second carriage component supportably mounted in relation to the first carriage component and being movable with respect thereto, the second carriage component configured to transport the sewing machine along the lateral dimension of the quilting rack;

the first carriage component having an upper surface, the upper surface having a track formed along a length thereof and configured to restrict movement of the second carriage component to the direction defined by the lateral dimension of the quilting rack; and the second carriage having wheels configured to move along the length of the track formed on the upper surface of the first carriage component.

3. The quilting apparatus as defined in claim 1 further comprising a lamp configured to mount on the carriage assembly.

4. The quilting apparatus as defined in claim 1, wherein the table further comprises one or more legs, the one or more legs configured to support the table, wherein the one or more legs are adapted to fold to about the plane of the table for storage and transport.

5. The quilting apparatus as defined in claim 1, wherein the quilting rack comprises at least one support member having a length extending along the longitudinal dimension, the support member being configured to act as a spool for storing at least a portion of the fabric thereon, wherein the length of the support member is selectively adjustable to the length of the working surface.

6. The quilting apparatus as defined in claim 5, wherein the quilting rack further comprises two opposing end plates extending along the lateral dimension, each of the end plates comprising receiving apertures formed therein and at a spaced-apart relationship to each other, wherein the receiving apertures are configured to engageably receive the support members.

7. The quilting apparatus as defined in claim 6, wherein the support member comprises opposing ends having a locking member adapted to selectively lock relative to the receiving apertures of the opposing end plates.

8. The quilting apparatus as defined in claim 5 further comprising a locking mechanism configured to restrict rotation of the support member in a single direction.

9. The quilting apparatus as defined in claim 1 further comprising a height adjustment assembly configured to facilitate height adjustment of the quilting rack with respect to the working surface.

10. The quilting apparatus as defined in claim 9, wherein the height adjustment assembly comprises at least one vertical support configured to selectively engage the quilting rack.

11. The quilting apparatus as defined in claim 10, wherein the at least one vertical support comprises a slotted opening.

12. The quilting apparatus as defined in claim 11, wherein the quilting rack comprises an adjustable mechanism configured to engage the slotted opening of the at least one vertical support.

13. A quilting apparatus for guiding a sewing machine relative to at least one layer of fabric, the quilting apparatus comprising:

a table having a working surface;

a quilting rack configured to selectively take in and pay out the fabric in a substantially planar orientation defined by lateral and longitudinal dimensions, the quilting rack being mountable with respect to the working surface;

a carriage assembly supported by the working surface and configured to selectively transport the sewing machine with respect to the fabric along the lateral and longitudinal dimensions of the quilting rack;

a first manually operated fastener;

a second manually operated fastener;

a vertical support wherein the vertical support is rotatably connected to the table relative to an end of the vertical support by the first manually operated fastener, and the quilting rack is rotatably mounted to the vertical support by the second manually operated fastener;

wherein a horizontal position of the quilting rack is selectively adjustable in the lateral dimension of the working surface by selectively rotating the at least one vertical support;

wherein a vertical position of the quilting rack is selectively adjustable with respect to the working surface by selectively mounting the quilting rack to the at least one vertical support; and wherein a tilt of the quilting rack is selectively adjustable with respect to the working surface by selectively rotating the quilting rack on the at least one vertical support.

14. The quilting apparatus as defined in claim 13 further comprising a lamp assembly connected to the carriage assembly.

15. The quilting apparatus as defined in claim 14, wherein the lamp assembly includes a flexible arm, the flexible arm connected at an end to the lamp assembly and connected at another end to the movable carriage.

16. The quilting apparatus as defined in claim 14, wherein the lamp assembly is secured to a portion of the movable carriage, movable in one axis.

17. The quilting apparatus as defined in claim 14, wherein the lamp assembly is secured to a portion of the movable carriage, movable in two axes.

18. The quilting apparatus as defined in claim 14, wherein the table further comprises one or more legs, the one or more legs configured to support the table, wherein the legs are adapted to fold to about the plane of the table for storage and transport.

19. A quilting apparatus for supporting at least one layer of fabric in multiple positions relative to a movable sewing machine, the quilting apparatus comprising:

a table configured to support the movable sewing machine;

one or more legs configured to support the table;

a quilting rack configured to selectively pay out and take in the one or more layers of fabric in a substantially planner configuration;

a first vertical support;

a second vertical support;

the first vertical support rotatably connected to the table by a manually operated fastener relative to an end of the first vertical support;

the second vertical support rotatably connected to the table by another manually operated fastener relative to an end of the second vertical support;

the first vertical support rotatably connected by another manually operated fastener to the quilting rack;

the second vertical support rotatably connected by another manually operated fastener to the quilting rack;

wherein the manually operated fastener connecting the first vertical support to the table and the manually operated fastener connecting the second vertical support to the table enable a user to rotate the first vertical support and the second vertical support to position the quilting rack horizontally, wherein the manually operated fastener connecting the first vertical support to the quilting rack and the manually operated fastener connecting the second vertical support to the quilting rack enable the user to tilt the quilting rack and to position the quilting rack vertically relative to the table; and wherein the user may conveniently position the quilting rack for quilting with the movable sewing machine, for manual quilting, in a position for full access to the table with the quilting rack vertical, and in a transport mode with the one or more legs against the table.

20. The quilting apparatus as defined in claim 19, wherein the one or more legs are adapted to fold to about the plane of the table for storage and transport.

21. A quilting apparatus for supporting and moving a sewing machine relative to at least one layer of fabric, the quilting apparatus comprising:

a table;

a movable carriage configured to move in two axes relative to a surface of the table, the movable carriage adapted to support the sewing machine;

a quilting rack configured to selectively pay out and take in the one or more layers of fabric in a substantially planner orientation relative to the sewing machine on the movable carriage;

at least one vertical support rotatably connected at an end to the table and rotatably connected to the quilting rack; and one or more legs configured to support the table, the one or more legs foldable into about the plane of the table for storage and transportation.

22. The quilting apparatus as defined in claim 21, wherein the at least one vertical support is adapted to rotate to selectively place the quilting rack at two or more positions horizontally.

23. The quilting apparatus as defined in claim 21 further comprising a lamp configured to mount on the movable carriage.

24. A method for guiding a sewing machine relative to at least one layer of fabric mounted on a quilting rack, the method comprising the steps of:

paying out the fabric in a substantially planar orientation with the quilting rack defined by lateral and longitudinal dimensions;

mounting the quilting rack with respect to a working surface;

guiding the sewing machine with respect to the fabric along both the lateral and longitudinal dimensions of the quilting rack by means of a carriage assembly supported by the working surface;

connecting at least one vertical support rotatably to the table relative to an end of the at least one vertical support;

mounting the quilting rack rotatably to the at least one vertical support;

adjusting a horizontal position of the quilting rack selectively in the lateral dimension of the working surface by rotating the at least one vertical support selectively;

adjusting a vertical position of the quilting rack selectively with respect to the working surface by mounting the quilting rack selectively to the at least one vertical support; and adjusting a tilt of the quilting rack selectively with respect to the working surface by selectively rotating the quilting rack on the at least one vertical support.

* * * * *